United States Patent [19]

Kuo

[11] 4,169,775

[45] Oct. 2, 1979

[54] PROTECTION OF THE LOW HYDROGEN OVERVOLTAGE CATALYTIC COATINGS

[75] Inventor: Han C. Kuo, Burlington, Mass.

[73] Assignee: Olin Corporation, New Haven, Conn.

[21] Appl. No.: 929,375

[22] Filed: Jul. 31, 1978

[51] Int. Cl.[2] ..... C25B 1/16; C25B 1/26; C25B 9/04

[52] U.S. Cl. ..... 204/98; 204/128; 204/228; 204/248; 204/290 R

[58] Field of Search ..... 204/248, 98, 128, 252-258, 204/228, 290 R

[56] References Cited

FOREIGN PATENT DOCUMENTS 53-12798 2/1978 Japan .

*Primary Examiner*—R. L. Andrews

*Attorney, Agent, or Firm*—Bruce E. Burdick; Donald F. Clements; Thomas P. 0'Day

[57] ABSTRACT

An electrolytic cell having auxiliary circuit means for applying a cathodic protection current to cathode and exposed metal parts to help prevent corrosion thereof during cell shut-down.

8 Claims, 1 Drawing Figure

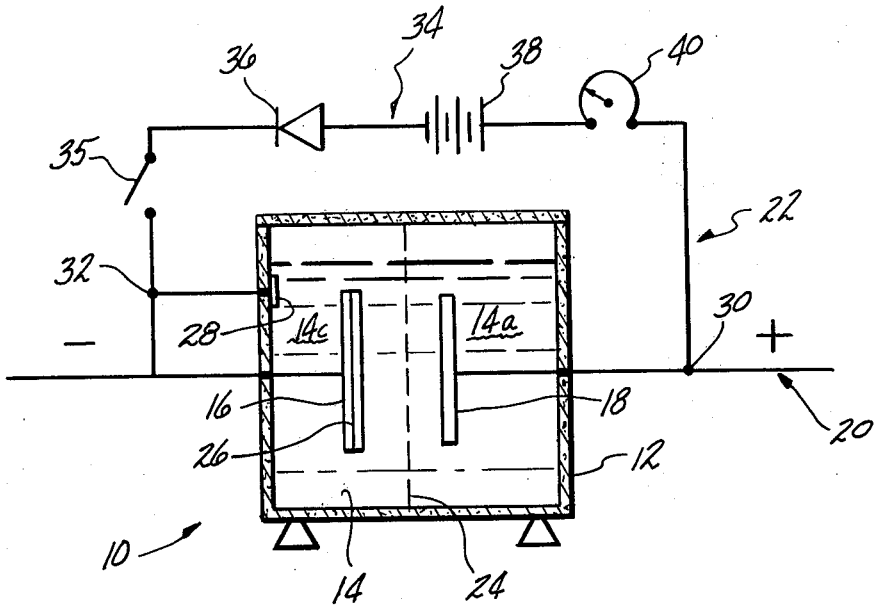
34
36
38
40
35
22
32
30
28
14c
14a
−
+
16
18
20
26
12
10
14
24

PROTECTION OF THE LOW HYDROGEN OVERVOLTAGE CATALYTIC COATINGS

This invention relates to electrochemical cells and more particularly to corrosion protection within such cells.

"Metal" is used broadly herein to refer to both pure metals and alloys.

Recently, various catalytic low hydrogen overvoltage alloy cathode coatings have been developed, such as Ni-Mo, Ni-Mo-V, Ni-Ti, precious alloys and others for chlor-alkali cell application. These coatings are generally plated or coated on steel or copper substrates. When the cells are shut down for any reason, the catalytically coated cathodes are immersed in the strongly caustic catholyte and corrosion of the coatings and bare copper or steel occur. If the cell is then restarted after such shut-down, the dissolved copper or iron ions are replated on top of the catalytic coatings and the catalytic activity of the catalytic coatings is degraded. There is thus a need for methods and apparatus for protecting the cathode coatings from such degradation.

A means of helping prevent such degradation is provided by the present invention. The present invention provides an electrolytic cell comprising:

(a) a cell housing for containing an electrolyte during electrolysis;

(b) an anode within said cell;

(c) a catalytically coated cathode within said cell;

(d) a primary power circuit means for providing current to said electrode during electrolysis; and (e) an auxiliary circuit means for applying and maintaining a negative potential on said cathode and all metal parts of said cell exposed to said electrolyte relative to said anode by supplying a DC cathodic protection current of density of from about 0.01 to 100 a/M$^2$ of cathode surface to said cathode during any time said primary circuit means is not providing a negative potential to said cathode, thereby protecting said cathode from becoming anodic with respect to any other cell during said time.

In another aspect, the invention provides a method of protecting a low hydrogen overvoltage cathode of a chlor-alkali cell having metal parts of a hydrogen overvoltage greater than the hydrogen overvoltage of the cathode, which comprises the steps of:

electrically connecting said metal parts which are exposed to said catholyte to the cathode during normal operation of said cell to thereby minimize differences in potential between said exposed metal parts and said cathode.

The objects and advantages of the invention will be better understood by reference to the following detailed description and the accompanying drawing in which:

FIG. 1, which is a schematic electrical diagram showing the auxiliary circuit means, and FIG. 1 shows schematically a cell 10 which comprises a cell housing 12, an electrolyte 14, an anode 18, a cathode 16, a primary circuit 20, an auxiliary circuit 22 and a membrane or diaphragm 24. Cell housing 12, electrolyte 14, anode 18, primary circuit 20 and membrane 24 can be of any suitable design, such as, for example, that shown in U.S. Pat. No. 3,898,149 issued to Kircher and Macken on Aug. 5, 1978, describing a diaphragm cell of monopolar design using dimensionally stable metal anodes, or could alternatively be a conventional bipolar or filter press type cell.

The cathode 16 is of the type having a conductive substrate such as steel, titanium, or copper and a catalytic coating 26, such as, for example, a Ni-Mo alloy having more than 50% by weight molybdenum or a Ni-Mo-V catalytic coating such as, for example, that disclosed in U.S. Pat. No. 4,033,837, issued July 5, 1977, to Kuo et al.

Auxiliary circuit means 22 is any means for applying and maintaining a negative potential on cathode 16 and coating 26 as well on any exposed metal parts 28 of housing 12 relative to the potential of anode 18, by supplying a DC cathodic protection current of a density of from about 0.01 to 100 amperes per square meter (a/M$^2$) of cathode surface area, and preferably of from about 0.01 to 0.1 a/M$^2$. Circuit means 22 includes a positive DC terminal 30, a negative DC terminal 32 and a DC power source 34 connected between said terminals. The preferred DC power source 34 comprises in series a switch 35, a diode 36, a battery 38, and a rheostat 40 in any desired order. Terminal 30 is connected to anode 18 while terminal 32 is connected to cathode 16 and any exposed metal parts 28 of housing 12. Battery 38 must have a higher voltage than the open circuit cell voltage. Any voltage that is sufficiently high works since rheostat 40 provides a means for controlling the current through circuit means 22. Battery 38 can preferably be a normal 12 volt lead-acid type car battery for economy or can be a more elaborate battery or an AC current rectified into DC. The type of power source 34 is of secondary importance to the primary feature of an auxiliary circuit means functionable during cell shutdown. The battery 38 has a great advantage that if normal domestic current to the cell is halted by a power failure, the battery will, by design, be able to cathodically protect the catalytic coating 26 of the cathode 16. Switch 35 and diode 36 serve to protect auxiliary circuit means 22 against damage by the very large currents normally passing through primary circuit means 20 during normal cell operation. Switch 35 could be opened during normal cell operation to minimize battery discharge and is closed immediately after any power loss in primary circuit 20. This closure of switch 35 could even be automated to assure immediate cathode protection.

Contaminants such as the metal ions Fe, Cu, Cr, Mn could be introduced into the catholyte under, for example, the following two conditions. First, when the cell is "shut-down", i.e. without current from primary circuit means 20, corrosion of exposed metal parts 28 of the cathode housing as well as any bare (uncoated) area of the cathode 18 could corrode into electrolyte 14. Although the corrosion rate is very slow, the metal ion concentration in the catholyte will continuously increase. Second, during cell operation some exposed metal parts 28 in the cathode chamber 42 of housing 12 could be under polarization potential higher than that of cathode 16 and could therefore slowly corrode into electrolyte 14. The dissolved metal ions which result from such corrosion would continuously increase if the outflow of electrolyte 14 from cell 10 was insufficient to remove as many ions as were being added due to such corrosion.

Since the catalytic coatings are of very low overvoltage, most metal ions are of a higher overvoltage than that of the coating and when plated on the coating undesirably increase the overvoltage and thus damage or degrade the effectiveness of the coatings in lowering overvoltage.

The cathode can be protected one of two ways from such corrosion. First, the catholyte 14c portion of electrolyte 14 can be drained from housing 12 and new contaminant-free electrolyte 14 be added in place thereof. However, such a method would waste electrolyte 14 and require disposal of a contaminated caustic and require laborious refilling operations and associated loss of valuable production. Furthermore, such a method does not solve the problem of metal ion contamination of caustic during prolonged periods of continuous normal operation.

Instead of continually substituting metal-ion-free electrolyte for electrolyte 14, it has been found to be preferable to electrically connect all exposed metal parts 28 which are in contact with catholyte 14c with cathode 16 so as to reduce any potential difference therebetween during cell operation and to enable auxiliary circuit means to cathodically protect parts 28 from corrosion during cell shut-down.

The invention is applicable to either diaphragm or membrane type electrolytic cells if the cathode is found to be anodic as respects exposed portions of the cell housing during cell shut-down.

The invention is further illustrated by the following examples:

EXAMPLE 1

A $2\frac{1}{2}'' \times 3\frac{1}{4}''$ sheet of copper mesh was cleaned and then plated at 400 a/M$^2$ for about 1 hour with a nickel molybdenum alloy in a citrate bath having the following composition: 24 grams nickel chloride per liter of bath solution (gpl), 6 gpl sodium molybdate, 80 gpl nickel sulfate, 88 gpl sodium citrate at a pH of 9.5. The Ni-Mo plated Cu sheet was then operated as the cathode in a membrane cell continuously for about ten weeks at 2000 a/M$^2$ current density and 85° C. temperature with a cation exchange membrane of the DuPont NAFION® sulfonic acid resin type. The cell showed a low overvoltage of about 210 millivolts (about 200 millivolts less than a steel cathode of comparable shape).

Another copper mesh of the same size as above was plated in a bath of composition: 45 gpl nickel sulfate, 180 gpl sodium pyrophosphate, 10 gpl sodium molybdate, 30 gpl ammonium chloride and ammonium hydroxide to adjust pH to 9.0. This mesh was then operated as the cathode in a membrane cell at a current density of 3000 a/M$^2$ and 85° C. temperature for about twelve weeks. Initially the cathode showed an overvoltage of about 230 millivolts and increased slowly to about 300 millivolts within the first three weeks of operation. The cathode then showed an overvoltage of about 300–350 millivolts during the next nine weeks of operation, which is about 100–150 millivolts below the overvoltage of a comparable steel cathode.

Both of the above two cells with the Ni-Mo alloy coated cathodes were occasionally subjected to cell shutdowns of various periods of from a few hours to a few days. Every time the cell was shut down, the current density was kept within a range of 10–100 a/M$^2$ by use of an auxiliary circuit means similar to that of FIG. 1.

Their consistently low overvoltage indicates corrosion protection of the cathodes was achieved as a result of the low current density applied to the cathode by the auxiliary circuit means.

EXAMPLE 2

A coppermesh of size $2\frac{1}{2}'' \times 3\frac{1}{4}''$ was plated in the pyrophosphate alloy plating bath of Example 1 at 0.5 KA/M$^2$ for 30 minutes. The cathode was put in a membrane cell and operated at a current density of 2 KA/M$^2$ and 85° C. with 22% by weight NaCl in the anolyte and 20–23% by weight NaOH in the catholyte. A bare copper rod of exposed area of about 8 cm$^2$ was immersed in the catholyte in back of the cathode and electrically connected to the cathode during operation. The cathode was operated for 2 days and showed a hydrogen overvoltage of about 0.12–0.22 v (steel: 0.35–0.45v.). The cell was cut off after 3 days operation and a current of about 0.055 ma was applied across the cell by using an auxiliary battery power system for protecting the cathode. After 5 days, the cell was returned to its normal current density load of 2 KA/M$^2$. The cathode exhibited the same overvoltage of about 0.22 v for the five days after the cutting down of the load.

The cell was then cut down to a current density of 0.055 ma (about 0.01 A/M$^2$) for another 3 days. After the additional 3 days of protection at low current density, the cathode was taken out for examining the coatings. It was found that the steel-color and shining Ni-Mo alloy were still on the surface without any copper overcoating.

The cathode was then put back into the cell and the bare copper rod was electrically disconnected from the cathode before the cell was restarted. After one day of operation, the cathode was found to be covered with red copper deposits and the overvoltage of the cathode had risen to about 0.35–0.4 v.

The above test indicated a bare copper in the cathode chamber without direct connection to the cathode will be subjected to corrosion during normal cell operation. The dissolved copper will continuously replate on the cathode surface which increases the cathode overvoltage. The corrosion of the bare copper in the catholyte during operation condition can be prevented by electrically connecting to the cathode. The corrosion of the bare copper in catholyte during cell down period can be prevented by cathodic polarization at a low current density (about 0.01 to 1 amp/M$^2$).

What is claimed is:

1. A method of protecting a low hydrogen overvoltage catalytic coating of a cathode of a chlor-alkali cell having an electrolyte in contact with said cathode and having exposed to said electrolyte at least one metal part comprised of a metal having a hydrogen overvoltage greater than the hydrogen overvoltage of the cathode, which comprises the steps of:

electrically connecting said metal part to the cathode coating during normal operation of said cell to thereby minimize differences in potential between said exposed metal parts and said cathode.

2. The method of claim 1 further comprising the step of:

applying a small cathodic protection direct current of from about 0.01 to about 1.0 amperes per square meter to the cathode coating and said parts to thereby protect it from corrosion while ceasing normal operation of said cell.

3. A method of protecting a low hydrogen overvoltage catalytic coating of a cathode of a chlor-alkali cell having an electrolyte in contact with said cathode and having exposed to said electrolyte at least one metal part of a hydrogen overvoltage greater than the hydrogen overvoltage of cathode, which comprises the steps of:

applying a small cathodic protection direct current of from about 0.01 to about 1.0 amperes per square meter to the cathode coating and said part to help protect said cathode from corrosion while ceasing normal operation of said cell.

4. An electrolytic cell comprising:

(a) a cell housing for containing an electrolyte during electrolysis;

(b) an anode within said cell;

(c) a catalytically coated cathode within said cell;

(d) a metal part of said cell, said metal part being exposed to said electrolyte and being comprised of a metal which, if deposited on said catalytic coating of said cathode would raise the hydrogen overvoltage of said coating;

(e) a primary power circuit means for providing a current between said anode and cathode during electrolysis; and (f) an auxiliary circuit means for applying and maintaining a negative potential on said cathode and all metal parts of said cell exposed to said electrolyte relative to said anode by supplying a DC cathodic protection current of a density of from about 0.01 to 100 a/M$^2$ of cathode surface to said cathode during any time said primary circuit means is not providing a negative potential to said cathode, thereby protecting said catalytic coating of said cathode from becoming cathodic with respect to any other exposed metal part of said cell during said time.

5. The cell of claim 4 wherein said electrode is a cathode, said exposed metal part is a metal portion of said cathode, said metal portion having a higher overvoltage than that of the catalytic coating of said cathode.

6. The cell of claim 5 wherein:

said auxiliary circuit means includes (a) a positive DC terminal connected to an anode of said cell;

(b) a negative DC terminal connected to said cathode; and (c) a DC power source connected between DC terminals.

7. The cell of claim 5 wherein said DC power source comprises:

(a) battery means for providing DC current to said cathode and said metal parts;

(b) a rheostat connected in series with said battery; and (c) a diode connected in series with said rheostat and battery.

8. The cell of claim 1, 5, 6 or 7 wherein said current density ranges from about 0.01 to about 0.1 a/M$^2$ of cathode surface area.

* * * * *